US007857151B2

(12) United States Patent
Barrese

(10) Patent No.: US 7,857,151 B2
(45) Date of Patent: Dec. 28, 2010

(54) TENSION ROD ASSEMBLY WITH ADAPTOR

(75) Inventor: Charles Barrese, Huntington, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 450 days.

(21) Appl. No.: 11/649,566

(22) Filed: Jan. 4, 2007

(65) Prior Publication Data

US 2008/0163418 A1 Jul. 10, 2008

(51) Int. Cl.
*A47H 1/08* (2006.01)

(52) U.S. Cl. ..... 211/105.3

(58) Field of Classification Search ..... 4/610; 211/105.1, 105.2, 124, 105.3, 105.4, 105.5, 211/105.6, 123; 16/12; 248/200.1, 251, 248/257, 259, 268; 403/372, 371, 367, 365
See application file for complete search history.

(56) References Cited

U.S. PATENT DOCUMENTS 727,454 A * 5/1903 Royce ..... 119/534
2,199,851 A * 5/1940 Culver ..... 248/264
2,492,517 A * 12/1949 Bernick ..... 211/123
2,974,806 A * 3/1961 Seewack ..... 211/123
3,333,808 A * 8/1967 Du Boff ..... 248/200.1
3,493,121 A * 2/1970 Doyle ..... 211/105.3
3,838,928 A * 10/1974 Blaurock et al. ..... 403/372
3,951,269 A * 4/1976 Anderson ..... 211/105.4
4,586,616 A * 5/1986 Cooper et al. ..... 211/88.04
4,636,106 A * 1/1987 Waisbrod ..... 403/228
4,981,390 A * 1/1991 Cramer et al. ..... 403/371
5,433,551 A * 7/1995 Gordon ..... 403/377
5,492,429 A * 2/1996 Hodges ..... 403/372
5,702,010 A * 12/1997 Liang ..... 211/105.1
5,826,847 A * 10/1998 Warner et al. ..... 248/354.1

(Continued)

FOREIGN PATENT DOCUMENTS

GB 2155325 A * 9/1985

(Continued)

OTHER PUBLICATIONS

The Free Dictionary, Finial—Definition of Finial, 2003, The American Heritage Dictionary of the English Language, 4th Edition copyright 2000 by Houghton Mifflin Company, Updated in 2003 <www.thefreedictionary.com/finial>.*

*Primary Examiner*—Darnell M Jayne
*Assistant Examiner*—Andres Gallego
(74) *Attorney, Agent, or Firm*—Alston & Bird LLP

(57) ABSTRACT

A tension rod assembly is provided that includes first and second telescoping rod sections. An outer diameter of the second rod section is larger than an outer diameter of the first rod section. First and second end members are provided. Each of the first and second end members has a recess with substantially the same inner diameter. The first end member is adapted to be received on the end of the first rod section. The second end member is adapted to be received on the end of the second rod section. An adapter is interposed between the end of the first rod section and the first end member. The adapter is configured to compensate for the difference in the outer diameters of the first and second rod sections such that identical end members can be used on both ends of the tension rod.

19 Claims, 2 Drawing Sheets

U.S. PATENT DOCUMENTS

| | | | | |
|---|---|---|---|---|
| 6,543,629 | B1 * | 4/2003 | Samelson | 211/105.1 |
| 6,845,955 | B1 * | 1/2005 | Hsu | 248/200.1 |
| 7,124,451 | B2 * | 10/2006 | Moore | 4/576.1 |
| 7,211,001 | B2 * | 5/2007 | Motyka et | 463/47.2 |
| 2002/0148796 | A1 * | 10/2002 | Lin | 211/123 |

FOREIGN PATENT DOCUMENTS

| | | | |
|---|---|---|---|
| JP | 02199305 | A * | 8/1990 |
| JP | 03092610 | A * | 4/1991 |

* cited by examiner

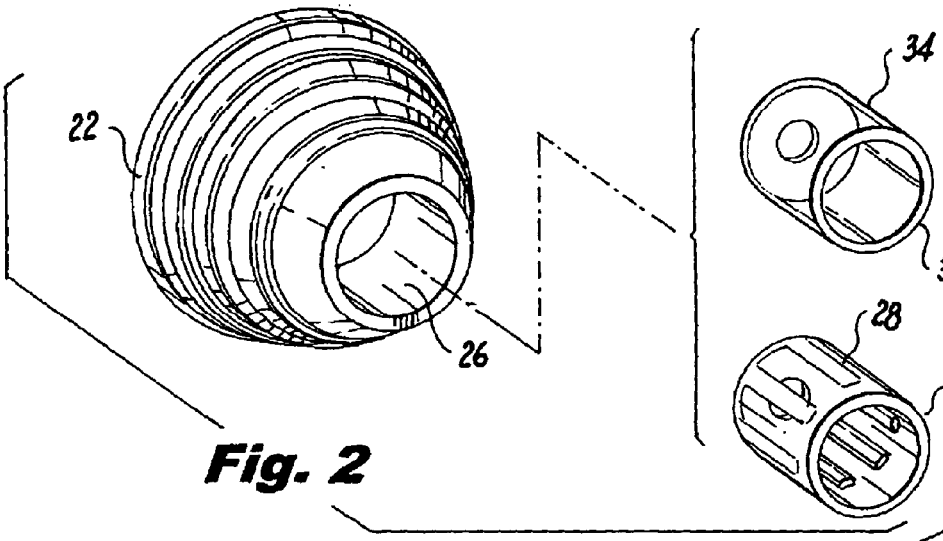
Fig. 2
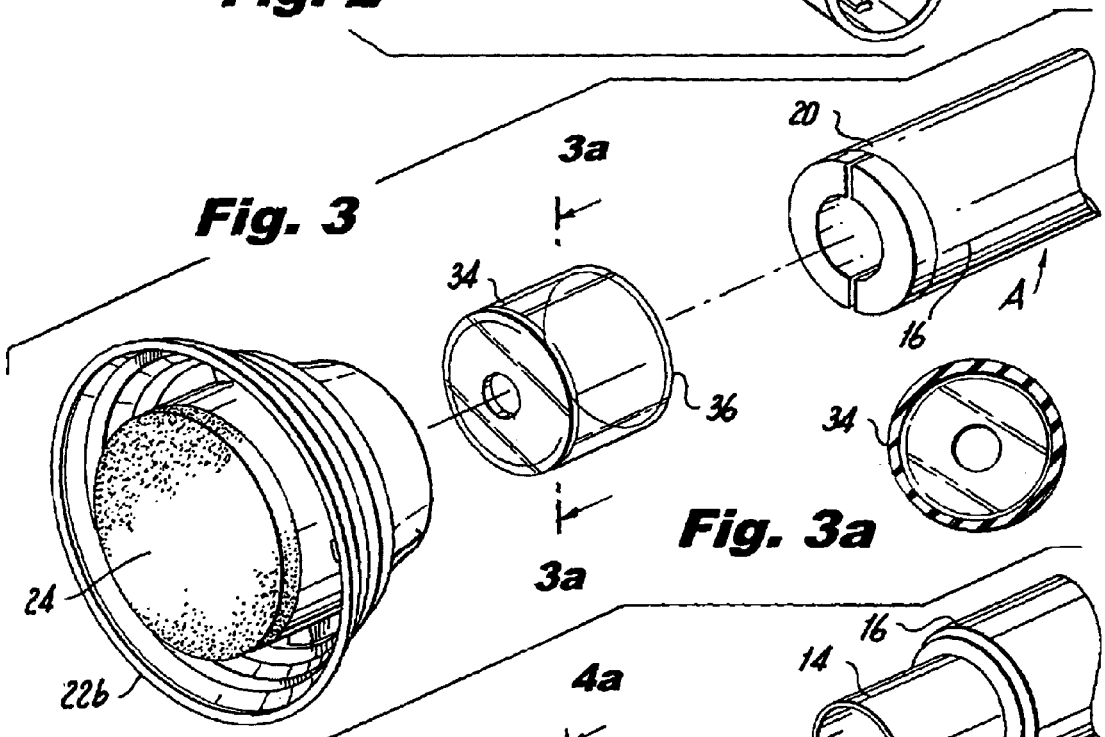
Fig. 3
Fig. 3a
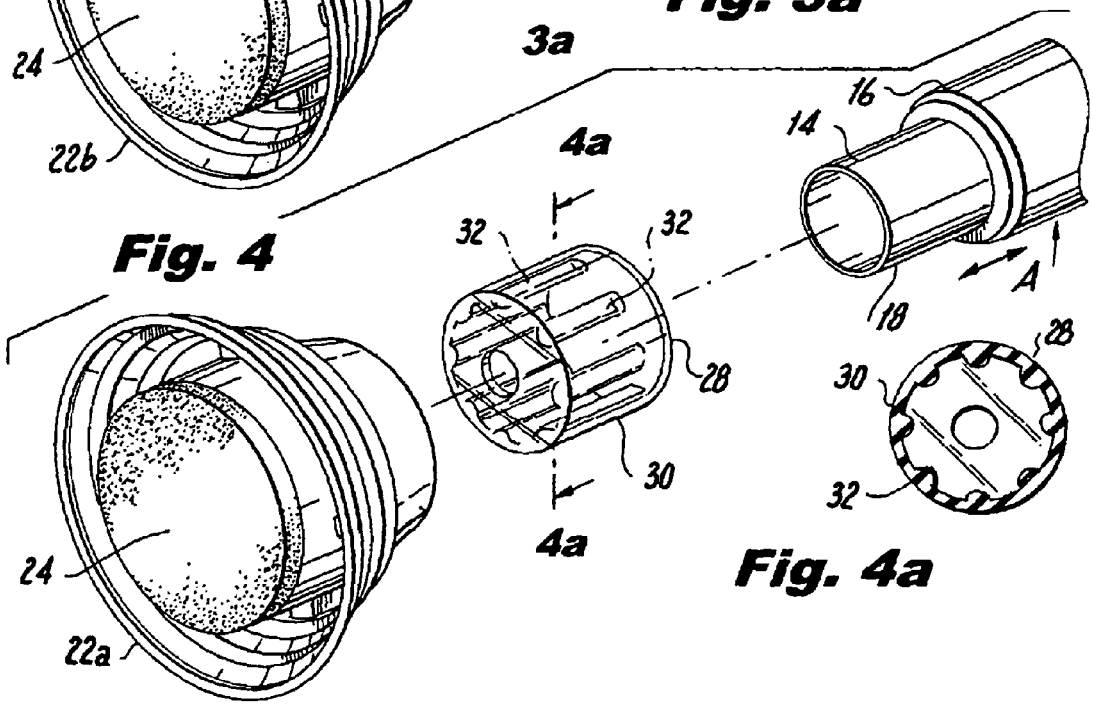
Fig. 4
Fig. 4a

TENSION ROD ASSEMBLY WITH ADAPTOR

BACKGROUND OF THE INVENTION

1. Field of the Invention

The present invention relates to tension rods for supporting curtains, such as shower curtains, and more particularly, to a tension rod assembly including an adaptor that permits the use of equal size finials at the ends of the tension rod.

2. Description of Prior Art Including Information Disclosed Under 37 CFR 1.97 and 1.98

Tension rods for use in supporting shower curtains and/or shower curtain liners between the opposing walls in a bath or shower enclosure are well known in the art. The effective length of such tension rods is altered by fabricating the rod to include first and second substantially cylindrical rod sections. The second rod section is made hollow and has an inner diameter larger than the outer diameter of the first rod section. Accordingly, the first rod section can be telescopically received within the second rod section to a depth that causes the tension rod to have the desired effective length to press the ends of the rod against the opposing walls to suspend the rod. One rod is then rotated relative to the other so as to lock the rod sections in that relative position.

Often the walls of the tub or shower enclosure are made of material with a smooth surface and may even be tile with a very smooth surface. Usually, the ends of the tension rod are each provided with an end member that includes a pressure surface, such as a rubber tip, adapted to bear against the wall. The pressure surface substantially increases the friction between the rod end and the wall to reduce the amount of force that must be applied to the wall surface to prevent the rod end from moving relative to the wall because of the weight of the shower curtain and/or shower curtain liner suspended from the rod. The end member also serves to prevent damage to the wall because it is resilient and therefore can deform to a certain extent as it is pressed against the wall surface.

The end members are usually hollow and cylindrical. Each has a recess into which the end of one of the rod sections is adapted to be received. The end members are mounted on the rod ends by fitting them over the ends of the respective rod sections.

It is preferable that the end members take the form of specially constructed decorative finials that hide the pressure surface and, at the same time, substantially enhance the aesthetic appearance of the tension rod. When finials are employed as end members, the tension rod appears very similar to a non-tension curtain support rod designed to be hung on a wall by brackets or the like which are fastened permanently to the wall by screws.

The aesthetics of the situation require that the end members have the identical external appearance and hence be of the same size. However, as noted above, the rod sections must have different outer diameters such that one can be received within the other to adjust the effective length of the tension rod. This creates a problem for the manufacturer of the tension rod.

In order for the end members to have the identical external appearance and at the same time fit on rod sections that have different outer diameters, it is necessary to fabricate and employ end members for the tension rod that have different size recesses. That substantially increases the fabrication and assembly costs associated with the tension rod.

It is, therefore, a prime object of the present invention to provide a tension rod assembly that utilizes identical end members.

It is another object of the present invention to provide a tension rod assembly that can be fabricated and assembled at reduced cost.

It is another object of the present invention to provide a tension rod assembly that utilizes an adaptor to compensate for the different outer diameters of the tension rod sections such that identical end members can be employed.

It is another object of the present invention to provide a tension rod assembly that utilizes adapters with different sizes at each end of the tension rod to compensate for the different outer diameters of the tension rod sections such that identical end members can be employed.

BRIEF SUMMARY OF THE INVENTION

In accordance with one aspect of the present invention, a tension rod assembly is provided. The assembly includes first and second substantially cylindrical rod sections. The first rod section has an end and an outer diameter. The second rod section is hollow and has an inner diameter larger than the outer diameter of the first rod section such that the first rod section may be telescopically received within the second section. The second rod section has an end and an outer diameter. The outer diameter of the second rod section is larger than the outer diameter of the first rod section. First and second end members are provided. Each of the first and second end members has a cylindrical recess with substantially the same inner diameter. The first end member is adapted to be received on the end of the first rod section. The second end member is adapted to be received on the end of the second rod section. An adapter is interposed between the end of the first rod section and the first end member.

The adapter constitutes a means for compensating for the difference in the outer diameters of the first and second rod sections.

The adapter has a generally cylindrical shape. It has a recess with an effective inner diameter substantially equal to the outer diameter of the end of the first rod section. It has an outer diameter substantially equal to said inner diameter of the recess of each of the end members.

The adapter has a recess defined by a wall with at least one internal protrusion. The protrusion is elongated. The protrusion extends axially.

The protrusion compensates for the difference in the outer diameters of said first and second rod sections.

The first end member preferably takes the form of a finial.

The assembly also has a second adapter. The second adapter has a substantially cylindrical shape. It has a recess with an effective inner diameter substantially equal to the outer diameter of second rod section. It has an outer diameter substantially equal to the inner diameter of the recess of each of the end members.

The second end member preferably takes the form of a finial.

In accordance with another aspect of the present invention, a tension rod assembly is provided. The assembly includes first and second substantially cylindrical rod sections. The first rod section has an end and an outer diameter. The second rod section is hollow and has an inner diameter larger than the outer diameter of the first rod section such that the first rod section may be telescopically received within the second section. The second rod section has an end and an outer diameter. The outer diameter of the second rod section is larger than the outer diameter of the first rod section. First and second end members are provided. Each of the first and second end members has a cylindrical recess with substantially the same inner diameter. The first end member is adapted to be received on the end of the first rod section. The second end member is adapted to be received on the end of the second rod section. A first adapter is interposed between the end of the first rod section and the first end member. A second adapter is interposed between the end of the second rod section and the second end member.

The first adapter constitutes means for compensating for the difference in the outer diameters of the first and said second rod sections.

Each of the first and second adapters has a recess with an effective inner diameter. The effective inner diameter of the first adapter is smaller that the effective inner diameter of the second adapter. The first adapter constitutes means for compensating for the difference in the outer diameters of the first and second rod sections.

The first adapter has a generally cylindrical shape. The second adapter also has a generally cylindrical shape.

The first adapter has a recess with an effective inner diameter substantially equal to the outer diameter of the first rod section. The second adapter has a recess with an effective inner diameter substantially equal to the outer diameter of the second rod section.

The first and second adapters each have an outer diameter substantially equal to the inner diameter of the recess of each of the end members.

The first adapter has a recess defined by a wall with at least one internal protrusion. The protrusion is elongated. The protrusion extends axially. The protrusion compensates for the difference in the outer diameters of the first and second rod sections.

The first end member preferably takes the form of a finial. The second end member also preferably takes the form of a finial.

BRIEF DESCRIPTION OF THE SEVERAL VIEWS OF DRAWINGS

To these and to such other objects that may hereinafter appears, the present invention relates to a tension rod assembly with adapter as described in detail in the following specification and recited in the annexed claims, taken together with the accompanying drawings, in which like numerals refer to like parts and in which:

FIG. 2 is an exploded isometric view of a finial and first and second adapters, illustrating that the finial can be mounted over either adapter;

FIG. 3 is an exploded isometric view of one end of the tension rod;

Figure 1:
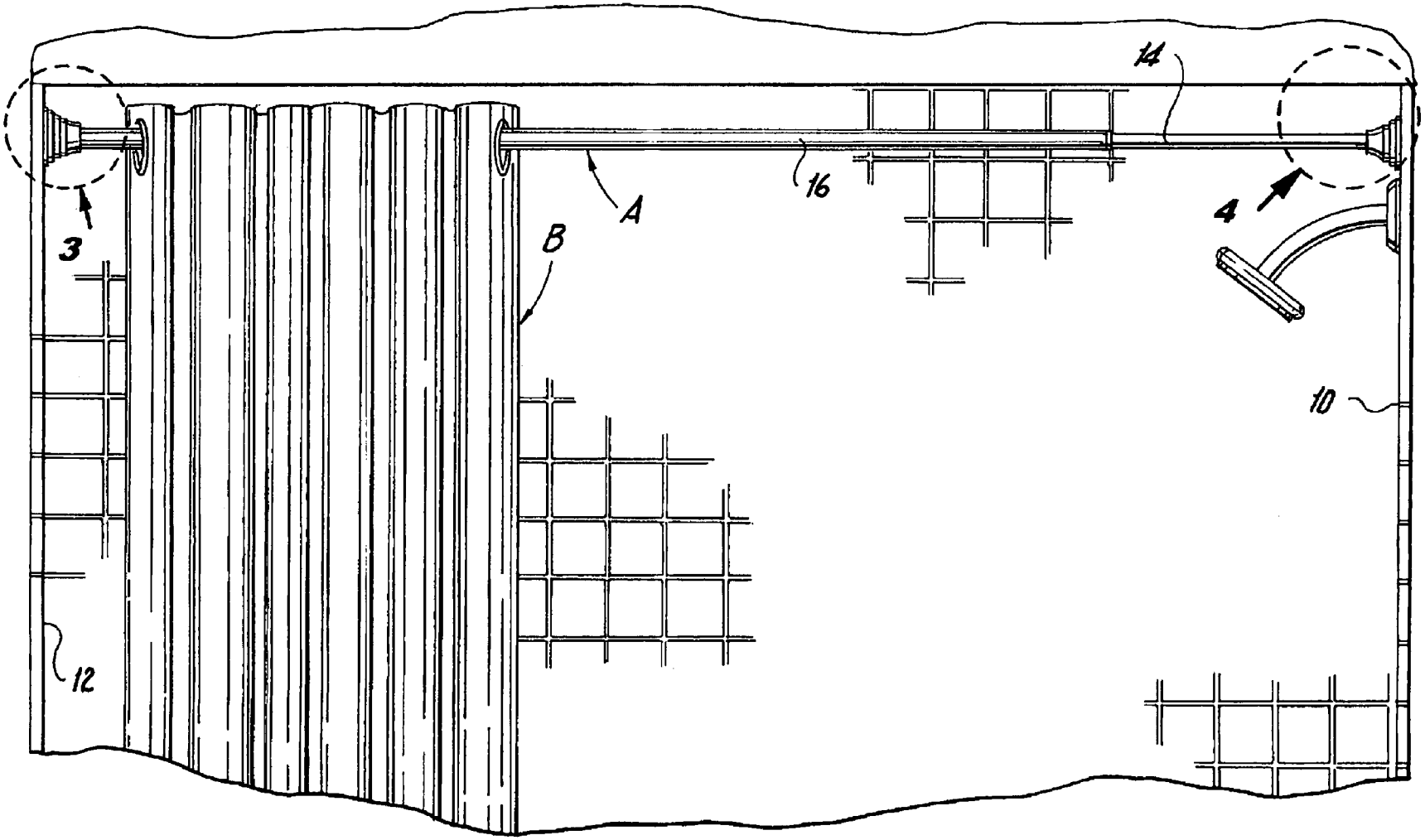
FIG. 1 is an environmental view showing the tension rod assembly of the present invention as it would appear installed in a tiled bath or shower enclosure.

FIG. 3*a* is an elevation view taken along line 3*a*-3*a* of FIG. 3;

FIG. 4 is an exploded isometric view of the other end of the tension rod; and FIG. 4*a* is an elevation view taken along line 4*a*-4*a* of FIG. 4.

DETAILED DESCRIPTION OF THE INVENTION

As seen in FIG. 1, the tension rod assembly of the present invention includes a conventional tension rod, generally designated A, Rod A is designed for use in a bath or shower stall between opposing walls 10, 12 to support a shower curtain and/or shower curtain liner, generally designated B.

Tension rod A includes first and second substantially cylindrical rod sections 14, 16. The first rod section 14 has an end 18 and an outer diameter. The second rod section 16 is hollow and has an inner diameter larger than the outer diameter of the first rod section 14 such that the first rod section 14 may be telescopically received within the second section 16. When the rod sections are moved relative to each other such that the rod A has the desired effective length, one rod section is rotated relative to the other to lock the sections in that position.

As seen in FIGS. 3 and 4, the second rod section 16 has an end 20 and an outer diameter. The outer diameter of the second rod section 16 is larger than the outer diameter of the first rod section 14.

First and second end members 22*a*, 22*b* are provided for mounting on rod ends 18, 20 respectively. The end members are identical. Each of the first and second end members 22*a*, 22*b* preferably takes the form of a finial with a generally conical decorative exterior enclosing a pressure pad 24. The pressure pad designed to bear against the enclosure wall 10, 12 to which it is mounted. Each pressure pad 24 preferably has a high friction, resilient surface so as to engage the wall without causing any damage. Each end member has a cylindrical recess 26 with substantially the same inner diameter.

The first end member 22*a* is adapted to be received on the end 18 of the first rod section 14. The second end member 22*b* is adapted to be received on the end 20 of the second rod section 16.

An adapter 28 is interposed between the end 14 of the first rod section 14 and within the first end member 22*a* (as shown in FIG. 1). Adapter 28 constitutes a means for compensating for the difference in the outer diameters of the first and second rod sections such that identical end member can be used on both ends of rod A.

Adapter 28 is preferably made of plastic and is therefore an inexpensive part. It has a generally cylindrical shape and is hollow so as to define a recess, having an end cap with an opening (not labeled) shown in FIGS. 3-4*a*, with an effective inner diameter substantially equal to the outer diameter of end 18 of the first rod section 14. It has an outer diameter substantially equal to said inner diameter of the recess 26 of each of the end members.

The adapter recess defined by a wall 30 with a plurality of spaced internal protrusions 32. Protrusions 32 are elongated and extend axially.

The wall 30 and protrusions 32 combine to compensate for the difference in the outer diameters of the first and second rod sections such that identical finials can be used.

The assembly of the present invention can be used with a single adapter 28, as described above. In that instance, the inner diameter of recess 26 of the end members 22 is substantially equal to the outer diameter of the second rod section 16 so as to snuggly fit over end 20 of second rod section 16.

However, the assembly can be used with a second adapter 34, if desired. As seen in FIG. 2, both adapters 28, 34 have the same outer diameter, which is substantially equal to the inner diameter of recess 26 of the identical finials 22.

Like adapter 28, adapter 34 is hollow with a substantially cylindrical shape. It has a wall 36 defining a recess with an effective inner diameter substantially equal to the outer diameter of second rod section 16. Preferably, adapters 28 and 34 are substantially identical, except for protrusions 32 which compensate for the difference in the outer diameters of the rod sections such that identical end members can be used on both ends of the rod.

It will now be appreciated that the present invention relates to a tension rod assembly which includes first and second substantially cylindrical rod sections. The first rod section has an end and an outer diameter. The second rod section is hollow and has an inner diameter larger than the outer diameter of the first rod section such that the first rod section may be telescopically received within the second section. The second rod section has an end and an outer diameter. The outer diameter of the second rod section is larger than the outer diameter of the first rod section. First and second end members are provided. Each of the first and second end members has a cylindrical recess with substantially the same inner diameter. The first end member is adapted to be received on the end of the first rod section. The second end member is adapted to be received on the end of the second rod section. An adapter is interposed between the end of the first rod section and the first end member. The adapter constitutes a means for compensating for the difference in the outer diameters of the first and second rod sections such that identical end members can be used on both ends of the tension rod.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A tension rod assembly comprising:

first and second substantially cylindrical rod sections, wherein the first rod section defines first and second ends and an outer diameter, wherein the second rod section is hollow and defines first and second ends and an inner diameter that is larger than the outer diameter of the first rod section, wherein the first end of the second rod section is configured to receive the first end of the first rod section such that the first rod section is telescopically receivable within the second rod section, and wherein the second rod section further defines an outer diameter that is also larger than the outer diameter of the first rod section;

first and second end members, wherein each end member defines a cylindrical recess having an inner diameter, wherein the inner diameter of the first end member is substantially equal to the inner diameter of the second end member; and an adapter comprising a wall and an end cap, wherein the adapter is configured to fit over and engage the second end of the first rod section and is configured to be interposed between the second end of the first rod section and the first end member such that an inner surface of the end cap is configured to be next to the second end of the first rod section and the first end member is configured to fit over the adapter, wherein the adapter defines a single outer diameter that is substantially equal to the outer diameter of the second rod section, and wherein the second end member is configured to fit over and engage the second end of the second rod section.

2. The assembly of claim 1, wherein the adapter has a generally cylindrical shape.

3. The assembly of claim 1, wherein an inner surface of the wall comprises a plurality of spaced internal protrusions, each protrusion being elongated and extending axially, the plurality of spaced internal protrusions being configured to compensate for the difference between the outer diameters of the first and second rod sections.

4. The assembly of claim 1, wherein the end cap defines at least one opening.

5. The assembly of claim 1, wherein the first end member is a finial.

6. The assembly of claim 1, wherein the second end member is a finial.

7. A method of assembling a tension rod, comprising:

inserting a first end of a first substantially cylindrical rod section into a first end of a second substantially cylindrical hollow rod section, wherein the outer diameter of the first rod section is smaller than the inner diameter of the second rod section such that the first rod section is telescopically receivable within the second rod section;

fitting an adapter over and engaging the second end of the first rod section, wherein the adapter comprises a cylindrical wall to define a recess and an end cap, wherein an inner surface of the end cap is configured to be next to the second end of the first rod section, and wherein the adapter defines a single outer diameter;

fitting a first end member over the adapter, wherein the first end member defines a cylindrical recess having an inner diameter; and fitting a second end member over the second end of the second rod section, wherein the second end member defines a cylindrical recess having an inner diameter, wherein the inner diameter of the first end member is substantially equal to the inner diameter of the second end member.

8. The method of claim 7, wherein the outer diameter of the adapter is substantially equal to the outer diameter of the second rod section.

9. The method of claim 7, wherein the adapter is a first adapter, and wherein fitting the second end member over the second end of the second rod section comprises interposing a second adapter between the second end of the second rod section and the second end member, wherein the second adapter comprises a wall and an end cap, wherein an inner surface of the end cap of the second adapter is configured to be next to the second end of the second rod section, and wherein the second adapter defines a single outer diameter.

10. A tension rod assembly comprising:

first and second substantially cylindrical rod sections, wherein the first rod section defines first and second ends and an outer diameter, wherein the second rod section is hollow and defines first and second ends and an inner diameter that is larger than the outer diameter of the first rod section, wherein the first end of the second rod section is configured to receive the first end of the first rod section such that the first rod section is telescopically receivable within the second rod section, and wherein the second rod section further defines an outer diameter that is also larger than the outer diameter of the first rod section;

first and second end members, wherein each end member defines a cylindrical recess having an inner diameter, wherein the inner diameter of the first end member is substantially equal to the inner diameter of the second end member;

a first adapter comprising a wall and an end cap, wherein the first adapter is configured to fit over and engage the second end of the first rod section and is configured to be interposed between the second end of the first rod section and the first end member, wherein an inner surface of the end cap of the first adapter is configured to be next to the second end of the first rod section, and wherein the first end member is configured to fit over the first adapter; and a second adapter comprising a wall and an end cap, wherein the second adapter is configured to fit over and engage the second end of the second rod section and is configured to be interposed between the second end of the second rod section and the second end member, wherein an inner surface of the end cap of the second adapter is configured to be next to the second end of the second rod section, and wherein the second end member is configured to fit over the second adapter.

11. The assembly of claim 10, wherein the first adapter has a generally cylindrical shape.

12. The assembly of claim 10, wherein the second adapter has a generally cylindrical shape.

13. The assembly of claim 10, wherein an inner surface of the wall of the first adapter comprises a plurality of spaced internal protrusions, each protrusion being elongated and extending axially, the plurality of spaced internal protrusions being configured to compensate for the difference between the outer diameters of the first and second rod sections.

14. The assembly of claim 10, wherein an inner surface of the wall of the second adapter is substantially smooth.

15. The assembly of claim 10, wherein the end cap of the first adapter defines at least one opening.

16. The assembly of claim 10, wherein the end cap of the second adapter defines at least one opening.

17. The assembly of claim 10, wherein the first end member is a finial.

18. The assembly of claim 10, wherein the second end member is a finial.

19. The assembly of claim 10, wherein each adapter defines a single outer diameter.

* * * * *